US009411279B2

(12) United States Patent
Ishikawa

(10) Patent No.: US 9,411,279 B2
(45) Date of Patent: Aug. 9, 2016

(54) IMAGE FORMING AND FIXING APPARATUSES HAVING FIXING AND PRESSING ROTATING MEMBER AND RECTIFICATION ELEMENT

(71) Applicant: CANON KABUSHIKI KAISHA, Tokyo (JP)

(72) Inventor: Junji Ishikawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/942,960

(22) Filed: Jul. 16, 2013

(65) Prior Publication Data

US 2014/0037346 A1 Feb. 6, 2014

(30) Foreign Application Priority Data

Aug. 6, 2012 (JP) ..... 2012-174366

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/324, 33, 328, 330, 331, 320; 219/216
See application file for complete search history.

(56) References Cited

U.S. PATENT DOCUMENTS 6,933,480 B2 8/2005 Ohta
2003/0038125 A1* 2/2003 Kataoka et al. ..... 219/216
2004/0007569 A1 1/2004 Ohta
2004/0120737 A1* 6/2004 Kataoka et al. ..... 399/328
2004/0161254 A1* 8/2004 Martin et al. ..... 399/67

FOREIGN PATENT DOCUMENTS

JP H04-134371 A 5/1992
JP H04-274472 A 9/1992
JP H11-190953 A 7/1999
JP 2001100578 A * 4/2001 ..... G03G 15/20
JP 2006072097 A * 3/2006
JP 4040348 B2 11/2007

OTHER PUBLICATIONS

English machine translation of JP2001-100578 published Apr. 13, 2001.*
Japanese Office Action dated May 31, 2016, in counterpart Japanese Application No. 2012-174366.

* cited by examiner

*Primary Examiner* — Billy Lactaoen
(74) *Attorney, Agent, or Firm* — Fitzpatrick, Cella, Harper & Scinto

(57) ABSTRACT

By connecting a first diode between a conductive heating element of a fixing roller and ground, electric charge with the same polarity as the charged polarity of toner can be held on the surface of the fixing roller. Meanwhile, by connecting a second diode between the surface of a pressing roller that does not contact an un-fixed toner image and ground, electric charge with the reverse polarity of the charged polarity of the toner can be held at the surface of the pressing roller. The polarity of the electric charge induced by electromagnetic induction is held at the polarity determined by the two diodes, and as a result the fixing offset can be suppressed without adding a collector member or a charging capacitor.

13 Claims, 10 Drawing Sheets

IMAGE FORMING AND FIXING APPARATUSES HAVING FIXING AND PRESSING ROTATING MEMBER AND RECTIFICATION ELEMENT

BACKGROUND OF THE INVENTION

1. Field of the Invention

The present invention relates to a technique to suppress an offset of toner in a fixing unit that is mounted to an image forming apparatus.

2. Description of the Related Art

A fixing unit in an image forming apparatus applies heat to a toner image and a sheet in order to fix the toner image that is transferred to the sheet. Although ceramic heaters and halogen heaters were mainly used as a heat source, an electromagnetic induction heating method has come to be utilized in recent years. The electromagnetic induction heating method is a method to let the fixing roller generate heat by generating an eddy current in a fixing roller with an electromagnetic induction coil.

Incidentally, when a sheet passes the nip of the fixing unit, the surface of the fixing roller is charged by friction of the sheet with the fixing roller and a pressing roller. Meanwhile, the toner on the sheet that arrives at the fixing unit is charged by an image forming process. When the polarity of the surface of the fixing roller and the polarity of the toner are opposite from each other, or the polarity of the surface of the pressing roller and the polarity of the toner are the same, a so-called offset occurs, which is a phenomenon that the toner on the sheet adheres to the fixing roller.

In Japanese Patent No. 4040348, a bias circuit is proposed, which is configured to prevent the offset in a fixing unit in the electromagnetic induction heating method. This bias circuit collects electric charge by a collector member contacting a magnetic core, stores the collected electric charge in an external rectification circuit and a charging capacitor, and applies the stored electric charge to an electrically conductive layer of the fixing roller.

The bias circuit described in the Japanese Patent No. 4040348 has the advantage that it is capable to prevent the offset without providing a high voltage power supply for applying bias. However, in this bias circuit, since a collector member and a charging capacitor are required, a new problem has arisen, namely that it tends to increase the size and cost of the fixing unit.

SUMMARY OF THE INVENTION

Thus, the feature of the present invention is to suppress a fixing offset without adding a collector member or a charging capacitor.

The present invention provides a fixing apparatus comprising the following elements. A fixing roller, which includes an electrically conductive layer and a magnetic field generation unit that generates an eddy current in the electrically conductive layer by generating a magnetic field, generates heat by the eddy current flowing in the electrically conductive layer. An electric power supply unit causes the magnetic field generation unit of the fixing roller to generate the magnetic field by supplying electric power to the magnetic field generation unit. A pressing roller, which is arranged opposite to the fixing roller, and, together with the fixing roller, forms a pressing part that presses an un-fixed toner image to a sheet. A first rectification element, which is connected between the electrically conductive layer of the fixing roller and ground, and causes the surface of the fixing roller that contacts the un-fixed toner image to hold electric charge with the same polarity as the charged polarity of the un-fixed toner image. A second rectification element, which is connected between the surface of the pressing roller that does not contact the un-fixed toner image and ground, causes the surface of the pressing roller to hold electric charge with the reverse polarity of the charged polarity of the un-fixed toner image.

Further features of the present invention will become apparent from the following description of exemplary embodiments (with reference to the attached drawings).

DESCRIPTION OF THE EMBODIMENTS

Embodiment 1

Figure 1:
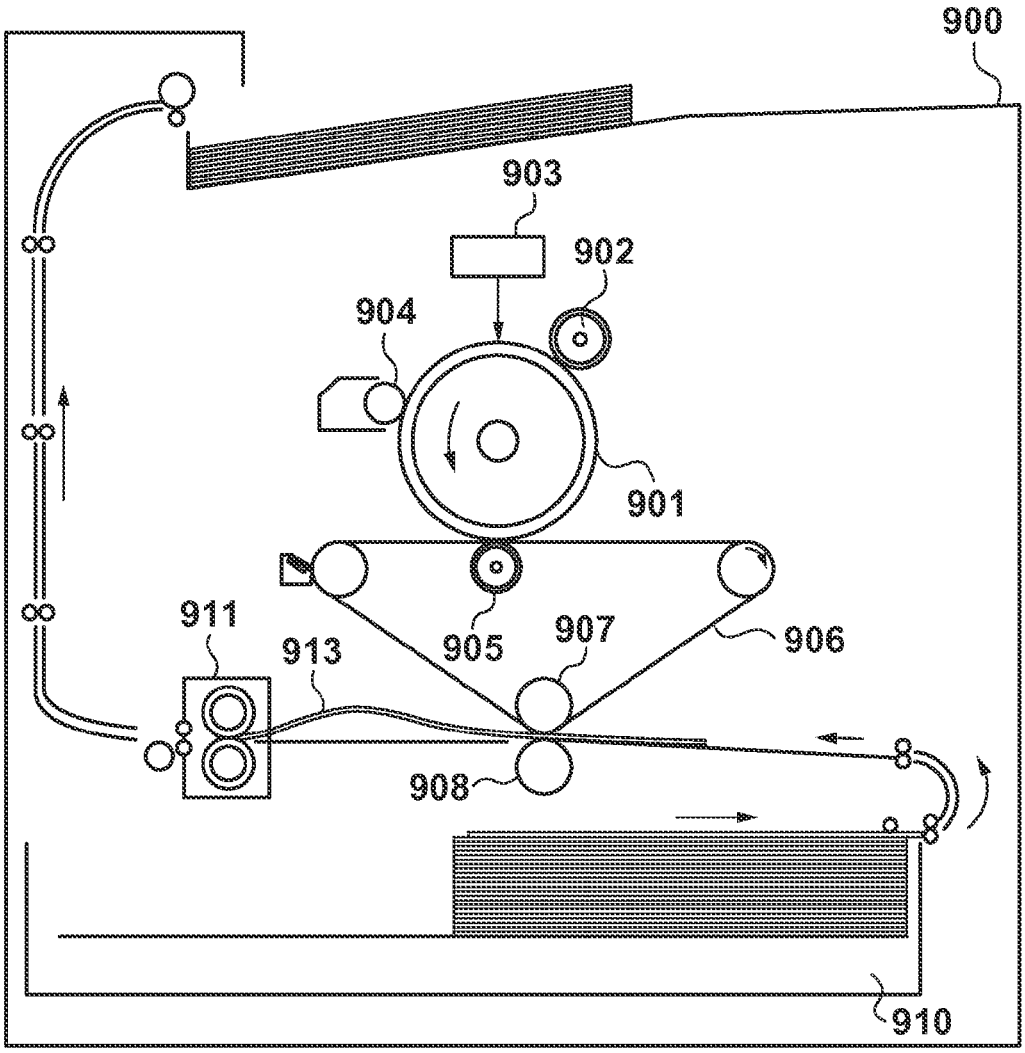
FIG. 1 is a diagram illustrating a general configuration of an image forming apparatus according to an embodiment of the present invention.

An image forming apparatus including a fixing unit will be described, with reference to FIG. 1. The image forming apparatus 900 is an image forming apparatus that uses an electrophotographic method. A photoreceptor drum 901 is an image carrier that carries an electrostatic latent image and a toner image. A primary charging roller 902 charges the surface of the photoreceptor drum 901 uniformly. A laser unit 903 irradiates the surface of the photoreceptor drum 901 with a laser beam, which is modulated by density information of the image, 1 to form the electrostatic latent image thereon. The laser unit 903 may be referred as an exposure apparatus or a light scanning apparatus. A developing sleeve 904 is a main unit of the developing unit, which forms a toner image by developing the electrostatic latent image formed on the surface of the photoreceptor drum 901 with toner. The toner is, for example, negatively charged. An intermediate transfer belt 906 is sandwiched between the photoreceptor drum 901 and a primary transfer roller 905. The toner that is carried on the surface of the photoreceptor drum 901 is primary-transferred to the surface of the intermediate transfer belt 906 by applying a primary transfer bias to the primary transfer roller 905. Accordingly, a toner image that is formed by negatively charged toner is formed on the intermediate transfer belt 906. The intermediate transfer belt 906 passes a nip unit that is formed by a secondary transfer internal roller 907 and a secondary transfer external roller 908. A cassette 910 accommodates a plurality of sheets 913. When a sheet 913 fed from the cassette 910 passes the nip unit, the toner image on the intermediate transfer belt 906 is secondary-transferred to the surface of the sheet 913. The sheet 913 that carries an un-fixed toner image is conveyed to a fixing unit 911, and is subjected to heat and pressure there so that the toner image is fixed on the surface of the sheet 913. Thus, components that relate to the formation of the toner image on the sheet, such as the photoreceptor drum 901, the intermediate transfer belt 906, and the like, constitute an image forming unit.

Figure 2:
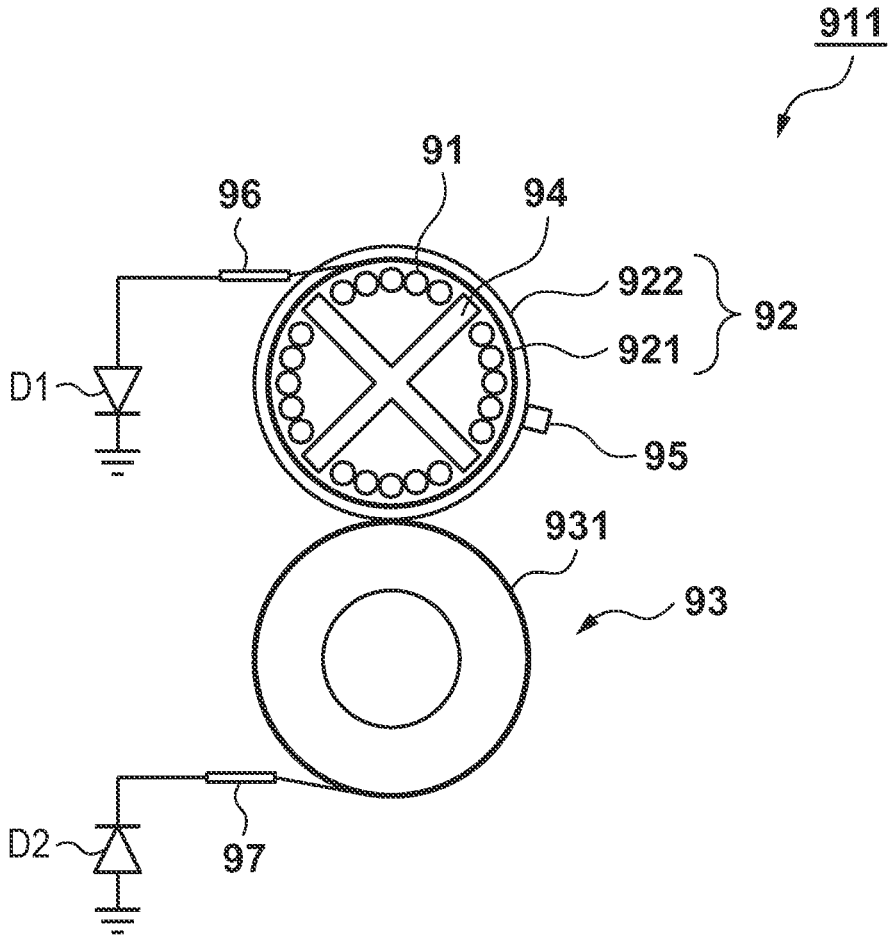
FIG. 2 is a diagram illustrating a fixing unit according to a first embodiment of the present invention.

A fixing unit 911 that uses an electromagnetic induction heating method will be described, with reference to FIG. 2. A fixing roller 92 includes a conductive heating element 921 with a thickness of, for example, lmm, and a non-conductive tube 922 that is stacked to cover the surface of the heating element 921. The conductive heating element 921 functions as an electrically conductive layer. Inside the fixing roller 92, an induction heating coil 91 is arranged in proximity to the conductive heating element 921. The induction heating coil 91 generates a magnetic field by the application of a high-frequency AC current. An eddy current is generated in the conductive heating element 921 of the fixing roller 92 by this magnetic field, and as a result the conductive heating element 921 generates heat due to the eddy current. The induction heating coil 91 functions as a magnetic field generation unit that generates an eddy current in the conductive heating element 921 by generating a magnetic field (magnetic flux). A ferrite core 94 improves the heat generation efficiency by focusing the magnetic flux generated by the induction heating coil 91 on the conductive heating element 921. A thermistor 95 is a temperature detecting element, which is in contact with the fixing roller 92 and measures the temperature of the fixing roller 92. Thus, the fixing roller 92 includes an electrically conductive layer and a magnetic field generation unit that generates an eddy current in the electrically conductive layer by generating the magnetic field, and generates heat by the eddy current that flows therein.

A pressing roller 93 is arranged opposite to the fixing roller 92, and is a roller that together with the fixing roller 92 forms a pressing part, which presses an un-fixed toner image to the sheet 913. The surface of the pressing roller 93 is covered by a conductive tube 931. Note that the fixing roller 92 rotates, following the pressing roller 93. Note further that it is assumed here that an un-fixed toner image is formed on a first face of the sheet 913, and either no un-fixed toner image is formed or a toner image that is already fixed is formed on a second face of the sheet 913. Thus, of the two surfaces of the sheet 913, the face on which an un-fixed toner image is formed contacts the fixing roller 92, and the face on which no un-fixed toner image is formed contacts the pressing roller 93.

The fixing temperature of the fixing unit 911 is changed, depending on the thickness, material, and the length of the sheet 913. For example, the target temperature To of the fixing temperature may be 180° C. The electrical power that is applied to the induction heating coil 91 is increased or decreased so that the fixing temperature detected by the thermistor 95 is kept at the target temperature To.

One end of a feeding brush 96 is in electrical contact with the conductive heating element 921 of the fixing roller 92. In other words, the conductive heating element 921 and the feeding brush 96 are electrically connected. The other end of the feeding brush 96 is connected to the anode of a first diode Dl, which is an example of a first rectification element. The cathode of the first diode Dl is connected to ground (grounding potential), such as a frame of the image forming apparatus 900, or the like. The reason why the first diode Dl is connected in this direction is that electric charge that has the same polarity as the charged polarity of the un-fixed toner image is to be held at that position of the surface of the fixing roller 92 that contacts the un-fixed toner image. In other words, the toner that constitutes the un-fixed toner image is kept from adhering to the surface of the fixing roller 92 by exercising the coulomb force (repulsive force) between the un-fixed toner image and the fixing roller 92.

One end of a feeding brush 97 is in electrical contact with the conductive tube 931 that covers the surface of the pressing roller 93. The other end of the feeding brush 97 is connected to the cathode of a second diode D2, which is an example of a second rectification element. The anode of the second diode D2 is connected to ground such as the frame, or the like. The reason why the second diode D2 is connected in this direction is that electric charge that has the polarity opposite to the charged polarity of the un-fixed toner image is to be held at that position of the surface of the pressing roller 93 that does not contact the un-fixed toner image. In other words, the toner is held on the sheet 913, and the toner that constitutes the un-fixed toner image is kept from adhering to the surface of the fixing roller 92 by exercising the coulomb force (attractive force) between the un-fixed toner image and the pressing roller 93.

Figure 3A:
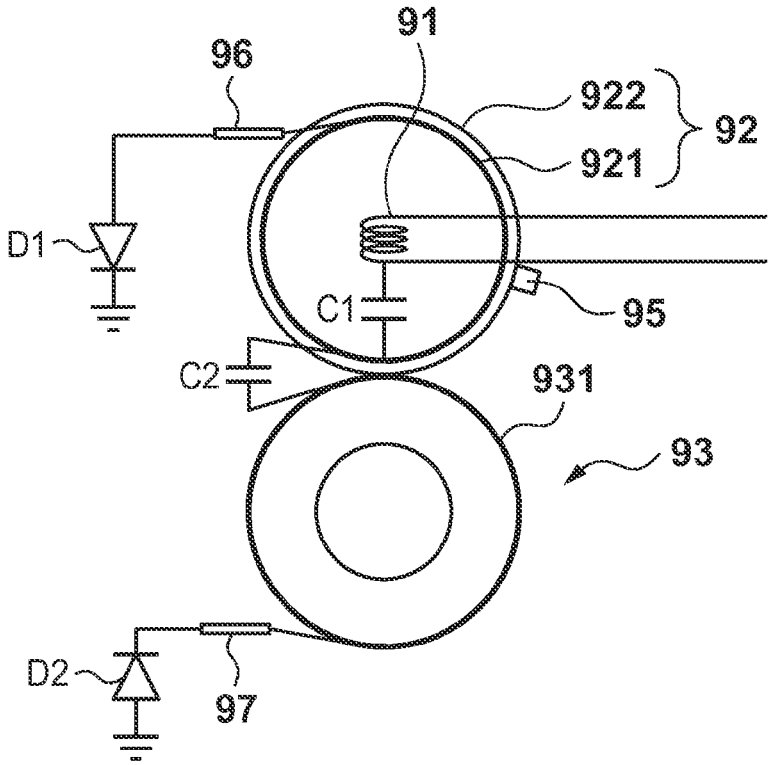
FIG. 3A is a diagram illustrating capacitance elements of a first embodiment of the present invention.

FIG. 3A illustrates capacitance elements formed in the fixing unit 911. C1 is a stray capacitance generated due to the induction heating coil 91 being in proximity to the heating element 921. C2 is a capacitance element formed between the conductive heating element 921 and the conductive tube 931. The non-conductive tube 922, which covers the surface of the fixing roller 92, functions as a dielectric material.

Figure 3B:
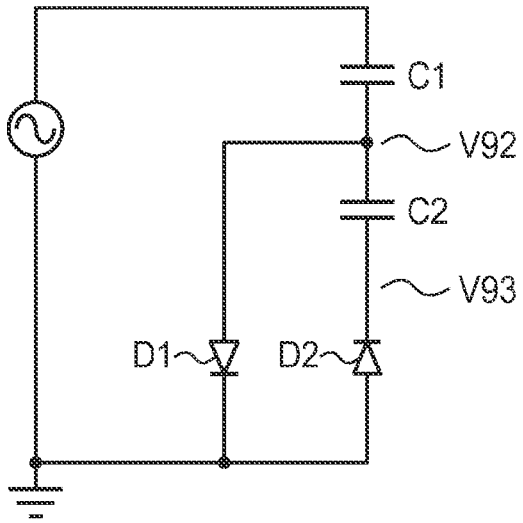
FIG. 3B is a diagram illustrating an equivalent circuit according to a first embodiment of the present invention.

FIG. 3B illustrates an equivalent circuit of the fixing unit 911. V92 is the potential of the conductive heating element 921 of the fixing roller 92. Note that V92 is the voltage between both ends of the first diode D1. V93 represents the potential of the conductive tube 931 on the surface of the pressing roller 93. V93 is also the voltage between both ends of the second diode D2.

Figure 4:
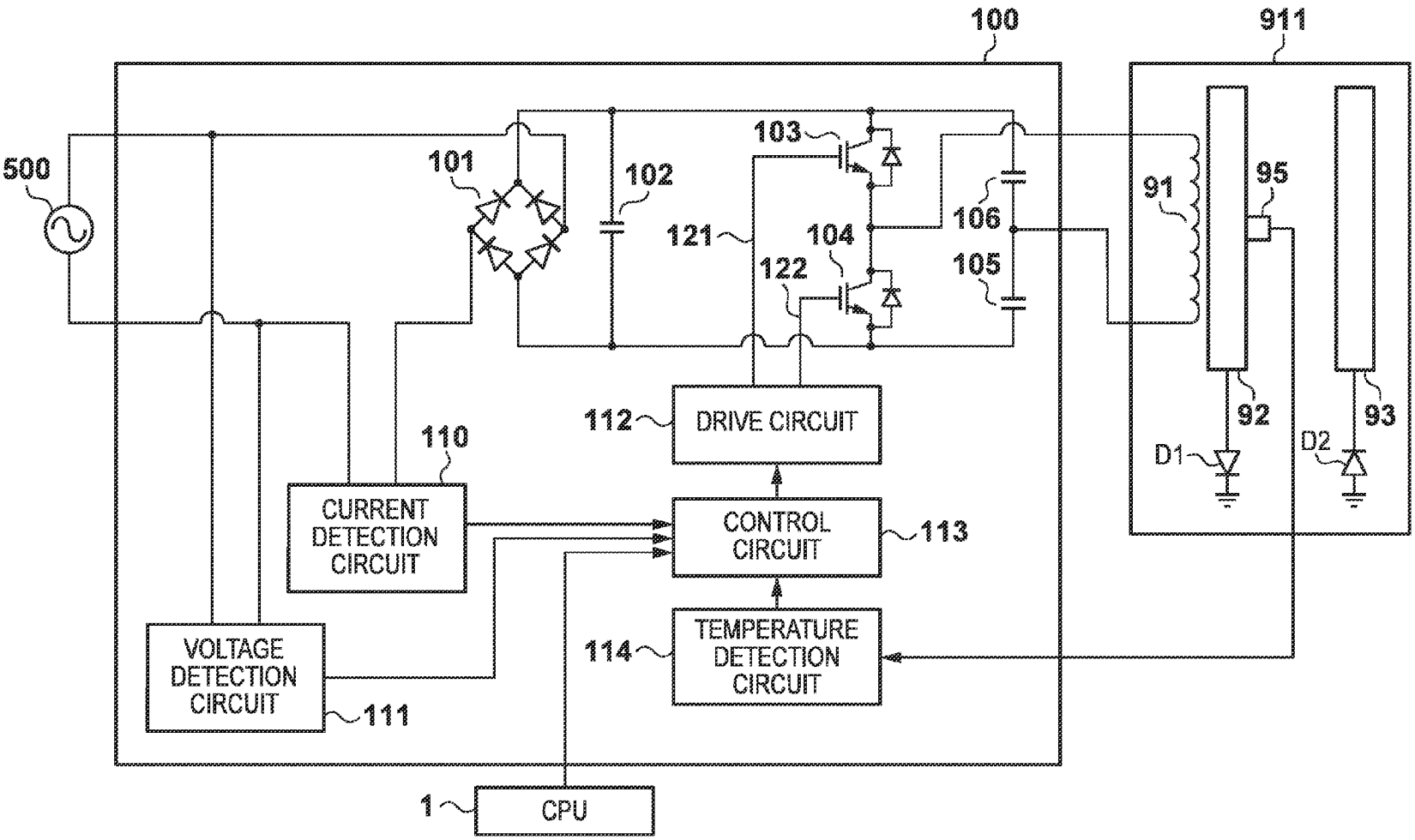
FIG. 4 is a block diagram of a main circuit according to a first embodiment of the present invention.

A method for applying electric power to the fixing unit 911 in the image forming apparatus 900 according to the first embodiment of the present invention will be described, with reference to the block diagram in FIG. 4. A power-supply apparatus 100, which is connected to a commercial power supply 500, is an apparatus that generates AC current for the induction heating coil 91 by converting the AC current from the commercial power supply 500, and applies the AC current to the induction heating coil 91. In other words, the power-supply apparatus 100 functions as an electric power supply unit that causes the induction heating coil 91 of the fixing roller 92 to generate a magnetic field by supplying electric power to the induction heating coil 91. The AC current from the commercial power supply 500 is rectified by a diode bridge 101, and is smoothed by a filter capacitor 102. Further, the DC current that is output from the filter capacitor 102 is again converted to an AC current by a resonant circuit. The resonant circuit is formed with resonant capacitors 105 and 106, and the induction heating coil 91. A drive circuit 112 outputs drive signals 121 and 122, and drives a first and a second switch element 103 and 104. A control circuit 113 is connected to a current detection circuit 110 that detects an input current from the commercial power supply 500, a voltage detection circuit 111 that detects an input voltage from the commercial power supply 500, and a temperature detection circuit 114 that detects the fixing temperature using the thermistor 95. An upper limit electric power Pmax is the maximum electric power on design, which is applicable to the induction heating coil 91. The upper limit electric power Pmax and the target temperature To are set to the control circuit 113 by a CPU 1. The control circuit 113 determines the pulse width of the drive signals 121 and 122 that are output from the drive circuit 112 so that the detection result of the temperature detection circuit 114 is equal to the target temperature To, and so that the current electric power P does not exceed the upper limit electric power Pmax, which is calculated by the detection results of the current detection circuit 110 and the voltage detection circuit 111. The switch elements 103 and 104 alternately turn on and off according to the drive signals 121 and 122, and supply high frequency current to the induction heating coil 91.

Image Forming Process

Figure 5:
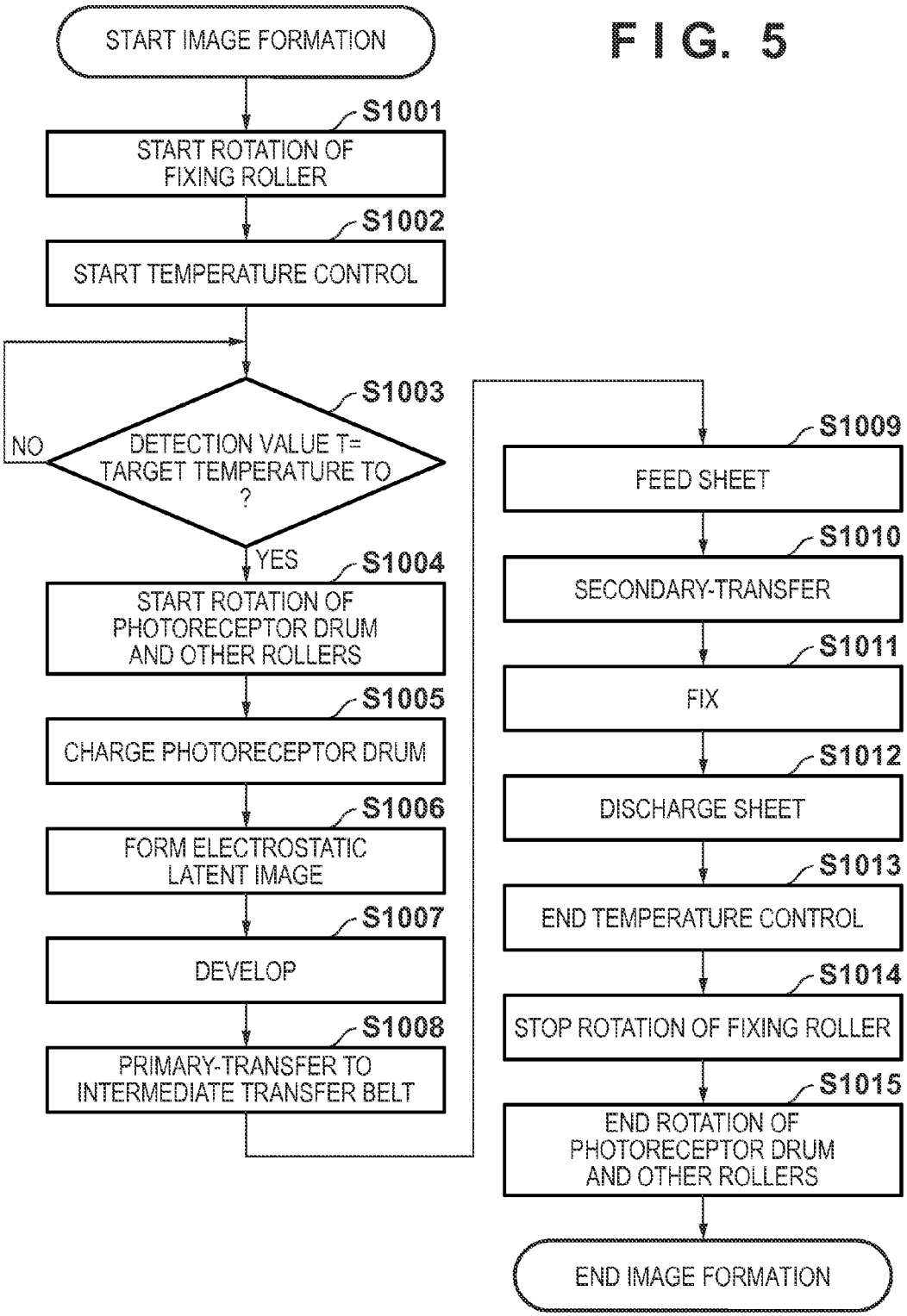
FIG. 5 is a flowchart illustrating an image forming operation according to an embodiment of the present invention.

With reference to FIG. 5, a basic image forming process will be described. In S1001, the CPU 1 controls a motor that drives the fixing roller 92, and starts rotation of the fixing roller 92. In S1002, the CPU 1 controls the power-supply apparatus 100, and starts adjusting the fixing temperature (fixing temperature control). For example, the CPU 1 sets control parameters such as the target temperature To of the control circuit 113. In S1003, the CPU 1 compares the detection value T of the fixing temperature with the target temperature To (for example: 180° C.), and waits for the detection value T to reach the target temperature To. When the detection value T reaches the target temperature To, the process advances to S1004. In S1004, the CPU 1 controls a motor, and starts rotation of the photoreceptor drum 901, the conveyance roller, and the like. In S 1005, the CPU 1 controls the charging bias of the primary charging roller 902, and causes the surface of the photoreceptor drum 901 to be charged at positive and uniform potential. In S1006, the CPU 1 controls the laser unit 903, and causes it to irradiate laser light on the surface of the photoreceptor drum 901, which has been uniformly charged, and to form an electrostatic latent image thereon. In S 1007, the CPU 1 controls the developing bias of the developing sleeve 904, and the electrostatic latent image is developed on the photoreceptor drum 901 by toner, and as a result a toner image is formed. In S 1008, the CPU 1 controls the primary transfer bias, and the toner image on the photoreceptor drum 901 is primary-transferred to the intermediate transfer belt 906. In S1009, the CPU 1 drives a pickup roller that feeds a sheet 913 by controlling a motor, and the sheet 913 is conveyed from the cassette 910 to a conveyance path. In S 1010, the CPU 1 controls the motor that drives the conveyance roller, which conveys the sheet 913, so that the conveyance timing of the sheet 913 matches with the arriving timing of the toner image on the intermediate transfer belt 906. The CPU 1 further controls the secondary transfer bias, and the toner image on the sheet 913 is secondary-transferred. In S1011, the CPU 1 controls the fixing unit 911, and an un-fixed toner image on the sheet 913 is fixed. In S1012, the CPU 1 controls the motor that drives the conveyance roller, and the sheet 913 is discharged. In S1013, the CPU 1 ends adjustment of the fixing temperature. In S1014, the CPU 1 controls the motor to stop rotation of the fixing roller 92. In S 1015, the CPU 1 controls the motor to stop rotation of the photoreceptor drum 901 and other rollers, and ends the image forming operation.

Thus, the CPU 1 controls the power-supply apparatus 100 to supply electric power to the fixing unit 911 during the image formation, so that the fixing temperature of the fixing unit 911 is kept at a predetermined target temperature To.

Control of Fixing Temperature

Figure 6:
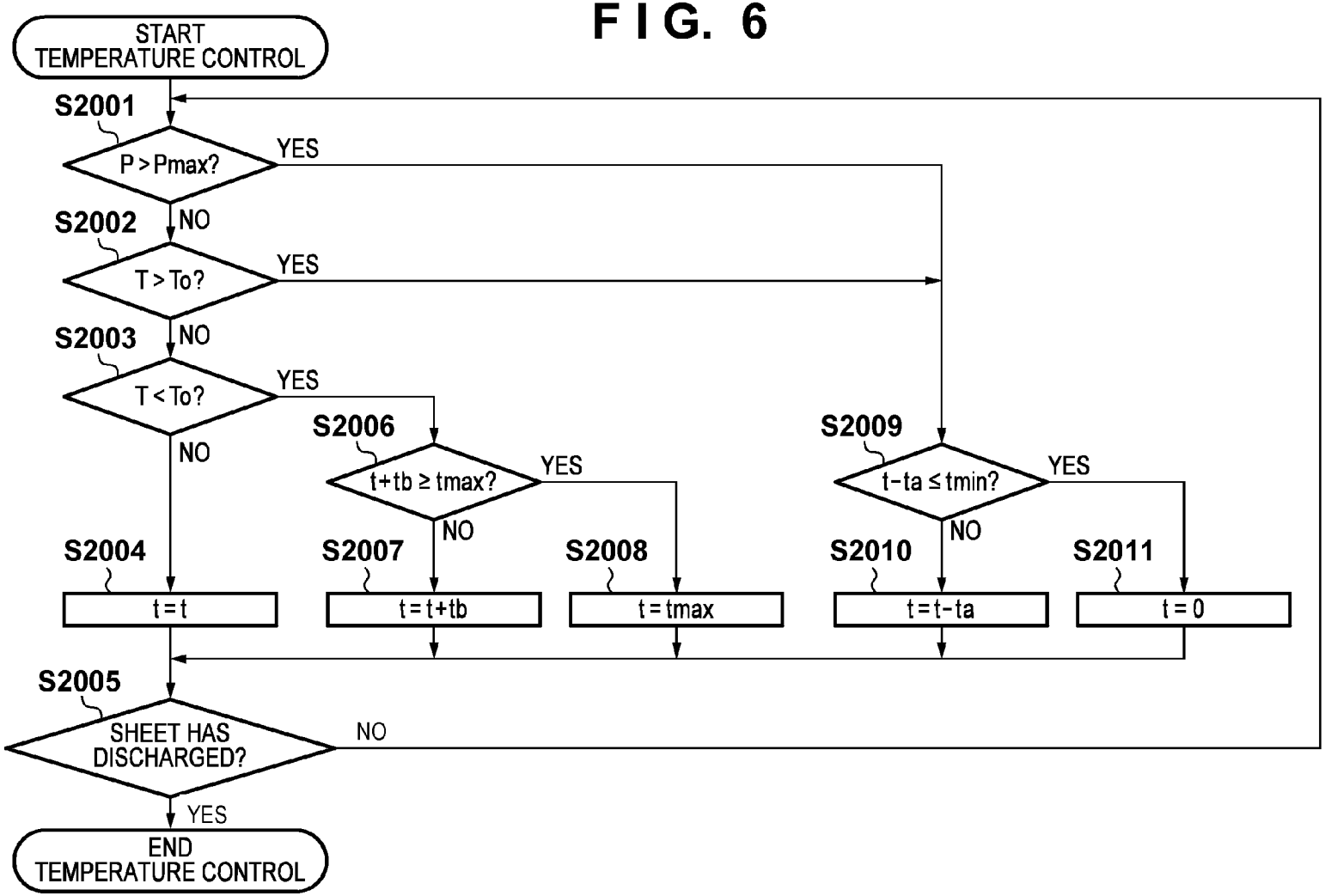
FIG. 6 is a flowchart of temperature control according to an embodiment of the present invention.

With reference to the flowchart in FIG.6, a temperature control method of the fixing unit 911 during the image formation will be described. Control parameters such as the upper limit electric power Pmax and the target temperature To are set for the control circuit 113 by the CPU 1. In the control of the fixing temperature, it is important to keep the fixing temperature at the target temperature To, and not to supply redundant electric power to the induction heating coil 91.

In S2001, the control circuit 113 compares the current electric power P with the upper limit electric power Pmax, and determines whether the current electric power P exceeds the upper limit electric power Pmax or not. If the current electric power P exceeds the upper limit electric power Pmax, an increase of the electric power P is not allowed, and the process advances to S2009. If the current electric power P does not exceed the upper limit electric power Pmax, the process advances to S2002.

In S2002, the control circuit 113 compares the detection value T of the fixing temperature with the target temperature To, and determines whether the detection value T exceeds the target temperature To. If the detection value T exceeds the target temperature To, since the fixing temperature needs to be decreased, the process advances to S2009. On the other hand, if the detection value T does not exceed the target temperature To, the process advances to S2003.

In S2003, the control circuit 113 compares the detection value T of the fixing temperature with the target temperature To, and determines whether the detection value T is less than the target temperature To or not. If the detection value T is less than the target temperature To, since the fixing temperature needs to be increased, the process advances to S2006. On the other hand, if the detection value T is not less than the target temperature To, in other words, if the detection value T is equal to the target temperature To, since the fixing temperature does not need to be increased or decreased, the process advances to S2004.

In S2004, the control circuit 113 keeps the pulse width t of the drive signals 121 and 122, which are output by the drive circuit 112, at the current pulse width t. Thereafter, advancing to S2005, the control circuit 113 determines whether the discharge of the sheet 913 is completed or not. If the output is not completed, that is, since the sheet 913 enters into the fixing unit 911 from now, the temperature control needs to be continued. Thus the process returns to S2001. On the other hand, if the discharge of the sheet 913 is completed, the temperature control is ended.

Process when fixing temperature needs to be decreased

In S2009, the control circuit 113 determines if, when the pulse width t is decreased by a predetermined decrement value ta, the difference between the pulse width t and the decrement value ta (t-ta) becomes equal to or less than the minimum pulse width tmin. If the difference between the pulse width t and the decrement value ta (t-ta) is greater than the minimum pulse width tmin, the process advances to S2010. In S2010, the control circuit 113 decreases the pulse width t by the decrement value ta. On the other hand, if the difference between the pulse width t and the decrement value ta (t-ta) is equal to or less than the minimum pulse width tmin, the process advances to S2011. In S2011, the control circuit 113 sets the pulse width t to 0. Accordingly, the pulse width t is prevented from becoming between 0 and the minimum pulse width tmin. The minimum pulse width tmin is decided by design. Thereafter, the process advances to S2005.

Process when fixing temperature needs to be increased

In S2006, the control circuit 113 determines if, when the pulse width t is increased by a predetermined increment value tb, the sum of the pulse width t and the increment value tb becomes equal to or more than the maximum pulse width tmax. If the sum of the pulse width t and the increment value tb is less than the maximum pulse width tmax, the process advances to S2007. In S2007, the control circuit 113 increases the pulse width t by the increment value tb. On the other hand, if the sum of the pulse width t and the increment value tb is equal to or more than the maximum pulse width tmax, the process advances to S2008. In S2008, the control circuit 113 sets the pulse width t to the maximum pulse width tmax, and then the process advances to S2005. Accordingly, the pulse width t is prevented from becoming longer than the maximum pulse width tmax.

Thus, the control circuit 113 increases and decreases the pulse width t of the drive signals 121 and 122 that the drive circuit 112 outputs, in order that the high frequency current flowing through the induction heating coil 91 is increased and decreased, so that the fixing temperature T is kept at the target temperature To.

Effect of Providing First and Second Diodes

As described above, in a conventional technique in which the first diode D1 and the second diode D2 are not provided, the polarity of the potential of the surface of the fixing roller 92 and the polarity of the potential of the surface of the pressing roller 93 respectively become the same as and opposite to the polarity of the charged potential of the toner, and as a result the offset is caused. For example, when the polarity of the potential of the surface of the fixing roller 92 becomes opposite to the polarity of the charged potential of the toner, the electrostatic holding force of the toner to the sheet 913 is weakened, and the toner tends to adhere to the fixing roller 92.

Figure 7:
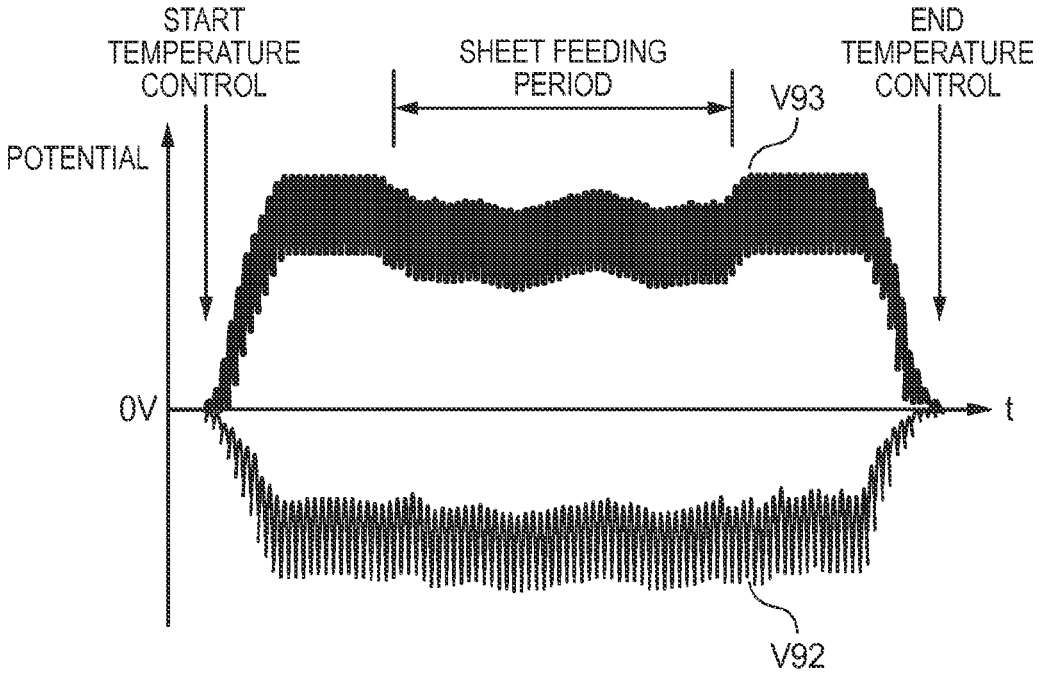
FIG. 7 is a diagram illustrating potential waveforms of an electrically conductive layer of a fixing roller and the surface of a pressing roller according to the present invention.

FIG. 7 illustrates waveforms of the potential V92 of the conductive heating element 921 of the fixing roller 92, and the potential V93 of the conductive tube 931 of the surface of the pressing roller 93, respectively. As shown in FIG. 7, when the temperature control is started and high-frequency AC current flows through the induction heating coil 91, the potential V92 of the fixing roller 92 becomes negative, and the potential V93 of the pressing roller 93 becomes positive. In the sheet feeding period thereafter, these polarities are kept this way. Thus, the electrostatic holding force of the toner to the sheet 913 is kept, and as a result the generation of the fixing offset can be reduced.

In this embodiment, an image forming unit in which the toner is negatively charged was described. The present invention can also be applied to an image forming unit in which the toner is positively charged. When an image forming unit in which the toner is positively charged is adopted, the same effect can be obtained by reversing the connecting direction of the first diode D1 and the second diode D2, respectively.

FIG. 1 illustrates an image forming apparatus 900 that includes an image forming unit in which a single-color image is formed. The present invention can also be applied to an image forming apparatus that forms a multi-color image. In an image forming apparatus that forms a multi-color image, the image forming process is almost the same, and the offset may be generated in the fixing unit 911.

Accordingly, in this embodiment, by connecting the first diode D1 between the conductive heating element 921 of the fixing roller 92 and ground, electric charge with the same polarity as the charged polarity of the toner can be held on the surface of the fixing roller 92. In other words, since the coulomb force (repulsive force) works between the electric charge on the surface of the fixing roller 92 and the toner on the sheet 913, the toner tends not to adhere to the fixing roller 92. Similarly, by connecting the second diode D2 between the surface of the pressing roller 93 that does not contact an un-fixed toner image and ground, electric charge with the reverse polarity to the charged polarity of the toner can be held on the surface of the pressing roller 93. Since the coulomb force (attractive force) works between the electric charge on the surface of the pressing roller 93 and the toner on the sheet 913, the toner is attracted towards the pressing roller 93 through the sheet 913, and tends not to adhere to the fixing roller 92. In other words, since the toner is attracted to the direction where the sheet 913 is present, the toner tends not to leave the sheet 913. Thus, since the polarity of electric charge that is induced by the electromagnetic induction is held at the polarity that is determined by the two diodes, the fixing offset can be suppressed without adding a new collector member or a charging capacitor.

Note that, although both the first diode D1 and the second diode D2 were provided in Embodiment 1, any one of these will suffice. In the case where only one of the first diode D1 and the second diode D2 is provided, although the effect to suppress the offset is reduced, when electric charge generated in the fixing unit 911 is small, only one of these diodes may be enough to suppress the offset.

In Embodiment 1, although the surface of the fixing roller 92 is configured by an electrically non-conductive layer (non-conductive tube 922) stacked on an electrically conductive layer (conductive heating element 921), the surface of the fixing roller 92 may be configured by an electrically conductive layer.

In Embodiment 1, although the first diode D1 and the second diode D2 were adopted as a rectification element, any element that has a rectification function can be adopted in place of the first diode D1 and the second diode D2. For example, transistors may be adopted in place of the first diode D1 and the second diode D2.

Embodiment 2

Embodiment 1 has the advantage that an offset can be suppressed by a relatively simple configuration, in which a first diode D1 and a second diode D2 were provided. Incidentally, when the potential generated by frictional electrification becomes too high, the voltage between the two ends of the first diode D1 and the voltage between the two ends of the second diode D2 may exceed the electrostatic breakdown voltage, which causes electrostatic breakdown.

Thus, this embodiment is characterized by a first variable resistor provided between a first diode Dl and ground to protect the first diode Dl from insulation breakdown. Furthermore, it is characterized by a second variable resistor provided between a second diode D2 and ground to protect the second diode D2 from insulation breakdown. Note that, by giving the same reference signs to constituent elements that were already described, explanation will be simplified.

Figure 8:
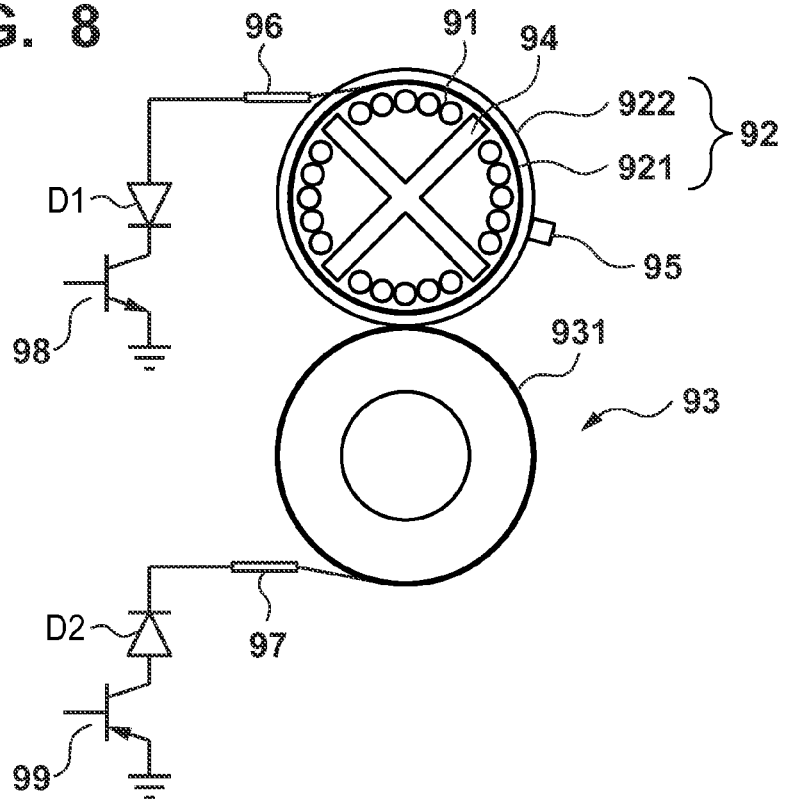
FIG. 8 is a diagram illustrating a fixing unit according to a second embodiment of the present invention.

With reference to FIG. 8, a fixing unit 911 in Embodiment 2 will be described. Here, although an example in which the first variable resistor and the second variable resistor are realized by transistors will be described, other circuit elements such as an authentic variable resistor may be utilized.

As shown in FIG. 8, a transistor 98 is serially connected between the cathode of the first diode D1 and ground. The transistor 98 is an npn-type transistor. Similarly, a transistor 99 is serially connected between the anode of the second diode D2 and ground. The transistor 99 is a pnp-type transistor. The types of the transistors 98 and 99 are selected according to the direction of the diodes. In other words, when the connection direction of the diode is reversed, the types of the transistors 98 and 99 are also changed.

Figure 9A:
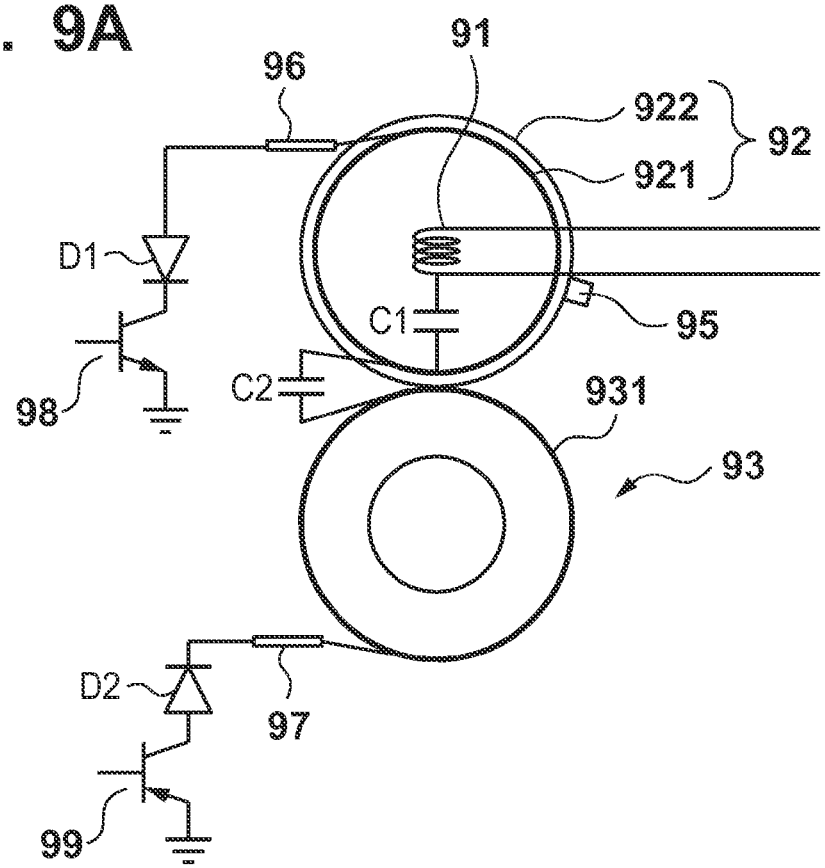
FIG. 9A is a diagram illustrating capacitance elements of a second embodiment of the present invention.
Figure 9B:
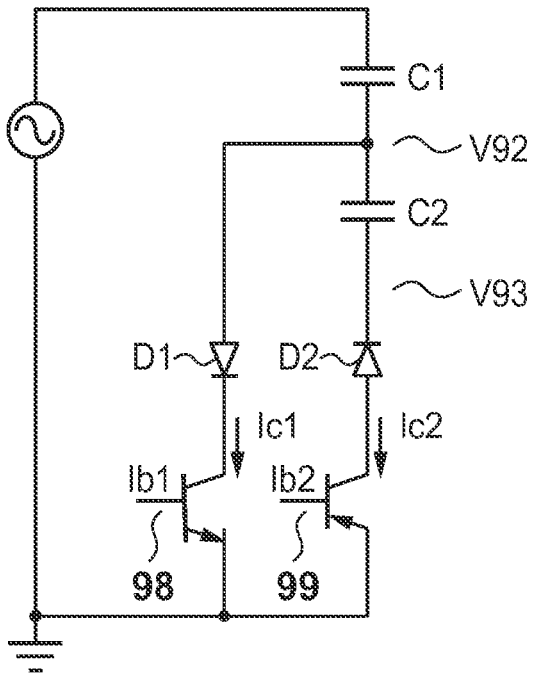
FIG. 9B is a diagram illustrating an equivalent circuit according to a second embodiment of the present invention.

FIG. 9A illustrates capacitance elements and the transistors 98 and 99 in the fixing unit 911. FIG. 9B illustrates an equivalent circuit of the fixing unit 911. By adjusting the base current Ib1 of the transistor 98, the collector current Ic1 can be adjusted. In other words, by adjusting the base current Ib1, the potential V92 of the conductive heating element 921 of the fixing roller 92 can be adjusted. Similarly, by adjusting the base current Ib2 of the transistor 99, the collector current Ic2 can be adjusted. In other words, by adjusting the base current Ib2, the potential V93 of the conductive tube 931 on the surface of the pressing roller 93 can be adjusted.

Figure 10:
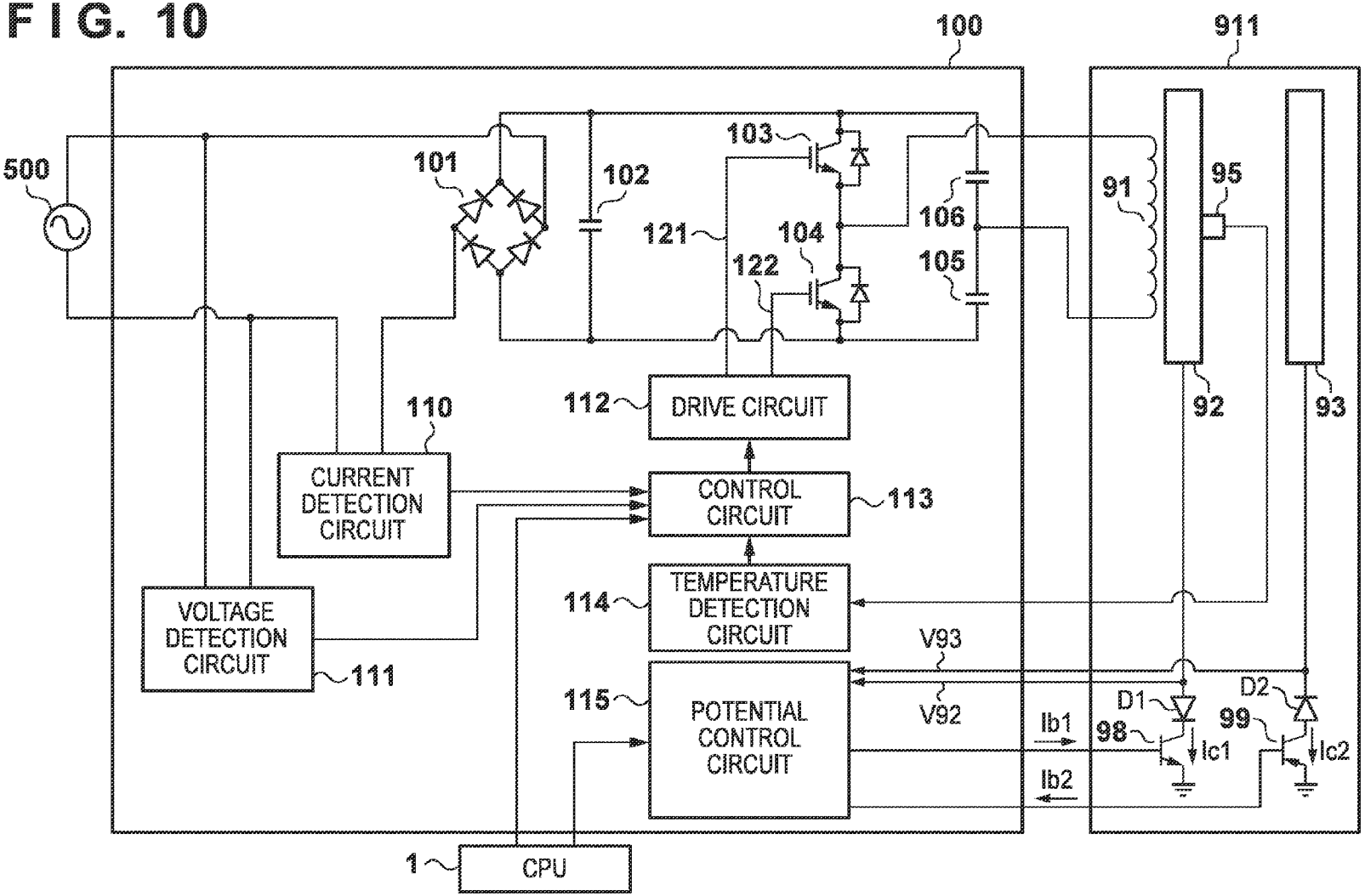
FIG. 10 is a block diagram of a main circuit according to a second embodiment of the present invention.

With reference to FIG. 10, a power-supply apparatus 100 will be described. In the power-supply apparatus 100, a potential control circuit 115 to control the potential of V92 and V93 is newly added. The potential control circuit 115 includes a voltage detection circuit to detect the potential V92 and V93. The potential control circuit 115 controls the base current Ib1 so that the potential V92 does not exceed the insulation breakdown voltage of the first diode D1. Similarly, the potential control circuit 115 controls the base current Ib2 so that the potential V93 does not exceed the insulation breakdown voltage of the second diode D2.

Fixing Potential Control

Figure 11:
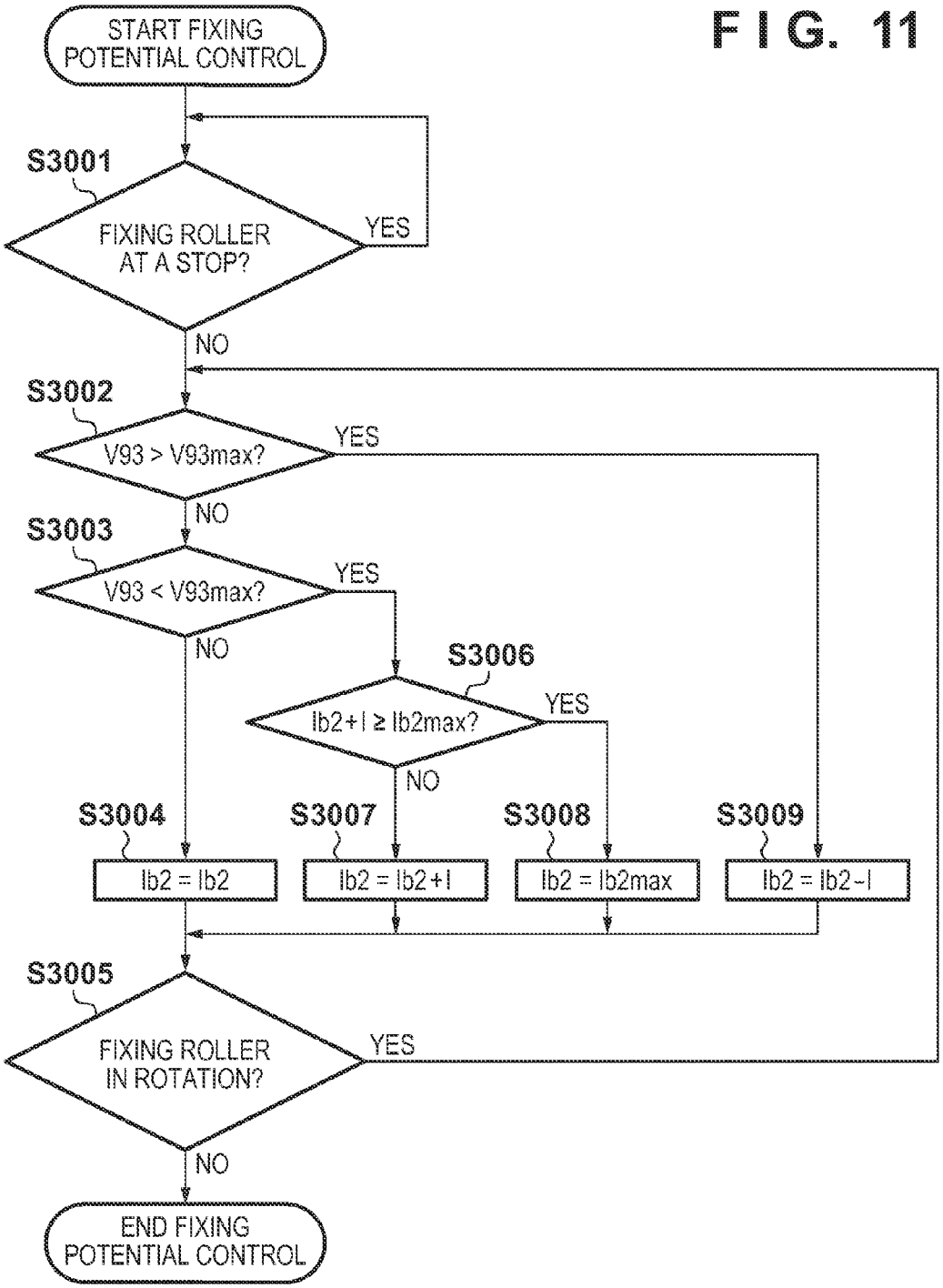
FIG. 11 is a flowchart illustrating fixing potential control according to the present invention.

Here, the control of the potential V92 and V93 is referred to as fixing potential control. Note that, the control flow is the same for the potential V92 and V93, except that the polarity of the potential is reversed. Thus, the control of the potential V93 will be described, with reference to FIG. 11.

In S3001, the potential control circuit 115 determines whether the fixing roller 92 is at a stop or not. Whether the fixing roller 92 is at a stop or not is determined by the control signal from the CPU 1. When the fixing roller 92 starts rotation, the process advances to S3002.

In S3002, the potential control circuit 115 compares the detection value of the potential V93 of the conductive tube 931 that is on the surface of the pressing roller 93 with the upper limit potential V93max, and determines whether the detection value of the potential V93 exceeds the upper limit potential V93max or not. If the detection value of the potential V93 exceeds the upper limit potential V93max, the potential V93 needs to be decreased so that the insulation breakdown of the second diode D2 can be prevented. Therefore, the process advances to S3009. In S3009, the potential control circuit 115 decreases the base current Ib2 by a predetermined value I, and the process advances to S3005. On the other hand, if the detection value of the potential V93 does not exceed the upper limit potential V93max, the process advances to S3003.

In S3003, the potential control circuit 115 compares the detection value of the potential V93 with the upper limit potential V93max, and determines whether the detection value of the potential V93 is less than the upper limit potential V93max or not. If the detection value of the potential V93 is not less than the upper limit potential V93max, in other words, if the detection value of the potential V93 is equal to the upper limit potential V93max, the process advances to S3004. In S3004, the potential control circuit 115 keeps the base current Ib2 at the current value, and the process advances to S3005. On the other hand, if the detection value of the potential V93 is less than the upper limit potential V93max, since the potential V93 has room for increase, the process advances to S3006.

In S3006, the potential control circuit 115 determines if, when the base current Ib2 is increased by I, the sum of the current base current Ib2 and I becomes equal to or more than the maximum base current Ib2max. If the sum of the current base current Ib2 and I is less than the maximum base current Ib2max, the process advances to S3007. In S3007, the potential control circuit 115 increases the base current Ib2 by I. On the other hand, if the sum of the current base current Ib2 and I becomes equal to or more than the maximum base current Ib2max, since the base current Ib2 cannot be increased, the process advances to S3008. In S3008, the potential control circuit 115 sets the base current Ib2 at the maximum base current Ib2max, and thereafter the process advances to S3005.

In S3005, the potential control circuit 115 determines whether the fixing roller 92 is rotating or not. If the fixing roller 92 is rotating, since the fixing potential needs to be controlled continuously, the process returns to S3002. On the other hand, if the fixing roller 92 is at a stop, the potential control circuit 115 ends the fixing potential control.

Thus, according to this embodiment, by providing a first variable resistor between the first diode D1 and ground to protect the first diode D1 from insulation breakdown, the insulation breakdown of the first diode D1 is suppressed along with suppressing the offset. Similarly, by providing a second variable resistor between the second diode D2 and ground to protect the second diode D2 from insulation breakdown, the insulation breakdown of the second diode D2 is suppressed along with suppressing the offset. Note that, as these variable resistors, although any type of resistor can be used as long as that can control the fixing potential, transistors can be adopted considering the ease of implementation. In this case, the potential control circuit 115 functions as a potential control unit that measures the fixing potential V92 and V93, and controls the base potential of the transistors 98 and 99 so that each of potential V92 and V93 does not exceed the insulation breakdown voltage. Thus, according to Embodiment 2, in addition to the effect of Embodiment 1, further effect, which is to suppress the toner offset in the region where the insulation breakdown in the first diode D1 and the second diode D2 will not occur, can be obtained. Only one of the first diode D1 and the second diode D2 may be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-174366, filed Aug. 6, 2012 which is hereby incorporated by reference herein in its entirety.

What is claimed is:

1. A fixing apparatus comprising:

a fixing rotating member, which includes an electrically conductive heating layer and a magnetic field generation unit that generates an eddy current in the electrically conductive heating layer by generating a magnetic field, and generates heat by the eddy current flowing in the electrically conductive heating layer;

an electric power supply unit that causes the magnetic field generation unit of the fixing rotating member to generate the magnetic field by supplying electric power to the magnetic field generation unit;

a pressing rotating member, which is arranged opposite to the fixing rotating member, and, together with the fixing rotating member, forms a pressing part that presses an un-fixed toner image to a sheet;

a first rectification element, which is connected between the electrically conductive heating layer of the fixing rotating member and ground, and causes the surface of the fixing rotating member that contacts the un-fixed toner image to hold electric charge with the same polarity as the charged polarity of the un-fixed toner image, the first rectification element being configured to connect to the electrically conductive heating layer of the fixing rotating member via a first electrically conductive brush;

a second rectification element, which is connected between the surface of the pressing rotating member that does not contact the un-fixed toner image and ground, and causes the surface of the pressing-rotating member to hold electric charge with the reverse polarity of the charged polarity of the un-fixed toner image, the second rectification element being configured to connect the surface of the pressing rotating member via a second electrically conductive brush; and a first electric potential adjusting element, which includes a transistor and is connected between the first rectification element and ground, configured to vary and adjust the electric potential induced at the electrically conductive heating layer due to behavior of the magnetic field generation unit.

2. The fixing apparatus according to claim 1, further comprising:

a potential control unit, which measures the voltage between two ends of the first rectification element, and controls the base potential of the transistor so that the voltage between the two ends does not exceed the insulation breakdown voltage of the first rectification element.

3. The fixing apparatus according to claim 1, further comprising:

a second electric potential adjusting element, which is connected between the second rectification element and ground, configured to vary and adjust the electric potential of the electrically conductive heating layer.

4. The fixing apparatus according to claim 3, wherein the second electric potential adjusting element includes a transistor.

5. The fixing apparatus according to claim 4, further comprising:

a potential control unit, which measures the voltage between two ends of the second rectification element, and controls the base potential of the transistor so that the voltage between the two ends does not exceed the insulation breakdown voltage of the second rectification element.

6. The fixing apparatus according to claim 1, wherein the surface of the fixing rotating member is an electrically non-conductive heating layer stacked on the electrically conductive heating layer.

7. The fixing apparatus according to claim 1, wherein the surface of the pressing rotating member is an electrically conductive heating layer.

8. The fixing apparatus according to claim 1, wherein at least one of the first rectification element and the second rectification element is a diode.

9. A fixing apparatus comprising:

a fixing rotating member, which includes an electrically conductive heating layer and a magnetic field generation unit that generates an eddy current in the electrically conductive heating layer by generating a magnetic field, and generates heat by the eddy current flowing in the electrically conductive heating layer;

an electric power supply unit that causes the magnetic field generation unit of the fixing rotating member to generate the magnetic field by supplying electric power to the magnetic field generation unit;

a pressing rotating member, which is arranged to be opposite to the fixing rotating member, and, together with the fixing rotating member, forms a pressing part that presses an un-fixed toner image to a sheet;

a rectification element, which is connected between the electrically conductive heating layer of the fixing rotating member and ground, and causes the surface of the fixing rotating member that contacts the un-fixed toner image to hold electric charge with the same polarity as the charged polarity of the un-fixed toner image, wherein the rectification element is configured to connect to the electrically conductive heating layer of the fixing rotating member via an electrically conductive brush; and a first electric potential adjusting element, which includes a transistor and is connected between the first rectification element and ground, configured to vary and adjust the electric potential induced at the electrically conductive heating layer due to the behavior of the magnetic field generation unit.

10. A fixing apparatus comprising:

a fixing rotating member, which includes an electrically conductive heating layer and a magnetic field generation unit that generates an eddy current in the electrically conductive heating layer by generating a magnetic field, and generates heat by the eddy current flowing in the electrically conductive heating layer;

an electric power supply unit that causes the magnetic field generation unit of the fixing rotating member to generate the magnetic field by supplying electric power to the magnetic field generation unit;

a pressing rotating member, which is arranged to be opposite to the fixing rotating member, and, together with the fixing rotating member, forms a pressing part that presses an un-fixed toner image to a sheet;

a rectification element, which is connected between the surface of the pressing rotating member that does not contact the un-fixed toner image and ground, and causes the surface of the pressing rotating member to hold electric charge with the reverse polarity as the charged polarity of the un-fixed toner image, wherein the rectification element is configured to connect the surface of the pressing rotating member via an electrically conductive brush; and a first electric potential adjusting element, which includes a transistor and is connected between the first rectification element and ground, configured to vary and adjust the electric potential induced at the electrically conductive heating layer due to the behavior of the magnetic field generation unit.

11. An image forming apparatus comprising:

an image forming unit that forms a toner image on a sheet; and a fixing unit that fixes the toner image on the sheet by applying heat and pressure to the toner image and the sheet, wherein the fixing unit comprises:

a fixing rotating member, which includes an electrically conductive heating layer and a magnetic field generation unit that generates an eddy current in the electrically conductive heating layer by generating a magnetic field, and generates heat by the eddy current flowing in the electrically conductive heating layer;

an electric power supply unit that causes the magnetic field generation unit of the fixing rotating member to generate the magnetic field by supplying electric power to the magnetic field generation unit;

a pressing rotating member, which is arranged to be opposite to the fixing rotating member, and, together with the fixing rotating member, forms a pressing part that presses an un-fixed toner image to a sheet;

a first rectification element, which is connected between the electrically conductive heating layer of the fixing rotating member and ground, and causes the surface of the fixing rotating member that contacts the un-fixed toner image to hold electric charge with the same polarity as the charged polarity of the un-fixed toner image, the first rectification element being configured to connect to the electrically conductive heating layer of the fixing rotating member via a first electrically conductive brush;

a second rectification element, which is connected between the surface of the pressing rotating member that does not contact the un-fixed toner image and ground, and causes the surface of the pressing rotating member to hold electric charge with the reverse polarity as the charged polarity of the un-fixed toner image, the second rectification element being configured to connect the surface of the pressing rotating member via a second electrically conductive brush; and a first electric potential adjusting element, which includes a transistor and is connected between the first rectification element and ground, configured to vary and adjust the electric potential induced at the electrically conductive heating layer due to the behavior of the magnetic field generation unit.

12. An image forming apparatus comprising:

an image forming unit that forms a toner image on a sheet; and a fixing unit that fixes the toner image on the sheet by applying heat and pressure to the toner image and the sheet, wherein the fixing unit comprises:

a fixing rotating member, which includes an electrically conductive heating layer and a magnetic field generation unit that generates an eddy current in the electrically conductive heating layer by generating a magnetic field, and generates heat by the eddy current flowing in the electrically conductive heating layer;

an electric power supply unit that causes the magnetic field generation unit of the fixing rotating member to generate the magnetic field by supplying electric power to the magnetic field generation unit;

a pressing rotating member, which is arranged to be opposite to the fixing rotating member, and, together with the fixing rotating member, forms a pressing part that presses an un-fixed toner image to a sheet;

a rectification element, which is connected between the electrically conductive heating layer of the fixing rotating member and ground, and causes the surface of the fixing rotating member that contacts the un-fixed toner image to hold electric charge with the same polarity as the charged polarity of the un-fixed toner image, wherein the rectification element is configured to connect to the electrically conductive heating layer of the fixing rotating member via an electrically conductive brush; and a first electric potential adjusting element, which includes a transistor and is connected between the first rectification element and ground, configured to vary and adjust the electric potential induced at the electrically conductive heating layer due to the behavior of the magnetic field generation unit.

13. An image forming apparatus comprising:

an image forming unit that forms a toner image on a sheet; and a fixing unit that fixes the toner image on the sheet by applying heat and pressure to the toner image and the sheet, wherein the fixing unit comprises:

a fixing rotating member, which includes an electrically conductive heating layer and a magnetic field generation unit that generates an eddy current in the electrically conductive heating layer by generating a magnetic field, and generates heat by the eddy current flowing in the electrically conductive heating layer;

an electric power supply unit that causes the magnetic field generation unit of the fixing rotating member to generate the magnetic field by supplying electric power to the magnetic field generation unit;

a pressing rotating member, which is arranged to be opposite to the fixing rotating member, and, together with the fixing rotating member, forms a pressing part that presses an un-fixed toner image to a sheet;

a rectification element, which is connected between the surface of the pressing rotating member that does not contact the un-fixed toner image and ground, and causes the surface of the pressing rotating member to hold electric charge with the reverse polarity as the charged polarity of the un-fixed toner image, wherein the rectification element is configured to connect the surface of the pressing rotating member via an electrically conductive brush; and a first electric potential adjusting element, which includes a transistor and is connected between the first rectification element and ground, configured to vary and adjust the electric potential induced at the electrically conductive heating layer due to the behavior of the magnetic field generation unit.

* * * * *